US007516857B2

(12) United States Patent
Müller et al.

(10) Patent No.: US 7,516,857 B2
(45) Date of Patent: Apr. 14, 2009

(54) CRANE WITH BOOM AND RUNNING TRACK FOR A CABLE CARRIER

(75) Inventors: Conrad Müller, Zell am Main (DE); Thomas Brummer, Wurzburg (DE)

(73) Assignee: Noell Crane Systems GmbH, Würzburg (DE)

( * ) Notice: Subject to any disclaimer, the term of this patent is extended or adjusted under 35 U.S.C. 154(b) by 0 days.

(21) Appl. No.: 11/636,209

(22) Filed: Dec. 8, 2006

(65) Prior Publication Data

US 2007/0227996 A1 Oct. 4, 2007

(30) Foreign Application Priority Data

Mar. 31, 2006 (DE) ..... 10 2006 015 430

(51) Int. Cl.
*B66C 13/12* (2006.01)

(52) U.S. Cl. ..... 212/271; 191/12 R; 212/325; 414/918

(58) Field of Classification Search ..... 212/325, 212/271; 191/12 R; 414/918
See application file for complete search history.

(56) References Cited

U.S. PATENT DOCUMENTS

| | | | | |
|---|---|---|---|---|
| 1,553,439 | A | 9/1925 | Goldberg | |
| 1,592,815 | A * | 7/1926 | Harris | 104/98 |
| 3,124,082 | A * | 3/1964 | Larsen | 104/98 |
| 3,132,598 | A * | 5/1964 | Pearson | 104/98 |
| 3,468,264 | A * | 9/1969 | Horompo | 104/98 |
| 3,532,227 | A * | 10/1970 | Tax | 212/325 |
| 3,554,385 | A * | 1/1971 | Munck | 212/225 |
| 3,722,705 | A * | 3/1973 | Gould | 212/198 |
| 3,778,855 | A * | 12/1973 | Kariagin et al. | 114/375 |
| 4,480,757 | A * | 11/1984 | Oustad | 212/257 |
| 4,762,240 | A * | 8/1988 | Thompson | 212/299 |
| 4,872,542 | A * | 10/1989 | Enneking | 198/312 |
| 5,524,548 | A * | 6/1996 | Fox | 104/89 |
| 6,196,133 | B1 | 3/2001 | Fitzler et al. | |

FOREIGN PATENT DOCUMENTS

| | | |
|---|---|---|
| DE | 41 20 284 A1 | 4/1992 |
| DE | 197 08 747 A1 | 9/1998 |
| DE | 197 13 489 A1 | 9/1998 |
| DE | 197 53 169 C2 | 6/1999 |

* cited by examiner

*Primary Examiner*—Thomas J. Brahan
(74) *Attorney, Agent, or Firm*—Collard & Roe, P.C.

(57) ABSTRACT

A crane with a boom, on which running tracks for cable carriers are disposed, having two running tracks for the cable carriers, which engage into one another with a positive lock. One running track is connected with the crane or the boom, and the other running track is displaceable on the crane or the boom.

7 Claims, 8 Drawing Sheets

Schnitt A-A von FIG 3

Tongue - and - groove Connection !

CRANE WITH BOOM AND RUNNING TRACK FOR A CABLE CARRIER

BACKGROUND OF THE INVENTION

1. Field of the Invention

The invention relates to a crane with a boom. The invention can be used anywhere where parts of the travel track of chassis that run on rails are movable, but are supposed to form a total, united travel track in the operating position, such as, for example, in crane construction for ship unloaders, container loading bridges, and other cranes with folding booms, for the travel track of the trolley power feed lines, but also for the power feed of stackers and other movable machines or devices that run on rails.

The crane according to the invention has the advantage that the running tracks of line cable carriers have a significantly lesser gap at the connection point between their fixed part and their movable part, and therefore greatly reduce the impact in the travel track resulting from the gap, when passing over the join, as well as the wear for the adjacent parts, such as wheels, bearings, and the running track itself.

2. The Prior Art

Cranes with booms are known. For example, in German Patent No. DE 197 13 489 A1, a loading bridge and a method for loading/unloading goods, particularly at ship docks, are described, with a portal-like base frame of at least four supports resting at least approximately vertically on a chassis, at least one beam, consisting of a fixed bridge beam extended beyond the portal on the land side, and a pivoting folded boom that is held in its horizontal position by means of pull rods mounted on a pylon in articulated manner. Trolleys that can move on travel tracks of the bridge beam and the boom are provided, which transport containers.

In order for the trolleys that move along their travel track on the crane and boom to be supplied with power, cable carriers move along a running track disposed below a beam, by means of which carriers a line or a line bundle can be moved out parallel to the boom. At all movable transitions of the crane, the running track has joins, which the cable carrier must cross with its wheels. Depending on the temperature difference, material, and design of the crane, these gaps can be several millimeters wide under disadvantageous conditions, and this results in significant stress on the bearings of the cable carrier, brings about vibrations of the crane, and results in great wear of both the running track of the cable carrier and of the bearings of the same.

This problem also occurs in the case of other movable chassis that run on rails, as described initially. In German Patent No. DE 197 53 169 C2, a device for suspension of a rail, particularly a rail in the shape of a hollow profile, open towards the bottom, of a suspended crane is described, with a lower metal beam that is attached to a chassis and on which a flexible element is supported. This element is situated between the lower metal beam and an upper metal beam that is parallel to the former, in the unstressed state, on which latter beam a tension element is supported, so that displaceablity between various elements exists.

From German Patent No. DE 197 08 747 A1, the suspension of a rail is known, and at least one additional element held at bias by the tension element is provided, to transfer pressure forces between the rail and the chassis.

These solutions are not suitable for solving the problem mentioned above.

In German Patent No. DE-OS 41 20 284 A1, a blocking and locking device for crane tracks is described, in which, after transport rails that are movable crosswise to one another have been aligned, the ends of the transport rails can be locked into one another after alignment, and, at the same time, barriers that are present at the ends are released.

The solution according to the invention provides driving the coupling and device for releasing the barrier with independent motors. This solution is not suitable for connecting running tracks for cable carriers, because of its complexity.

U.S. Pat. No. 1,553,439 describes a mechanism for unlocking crane tracks, which has an extraordinary number of parts and is therefore complicated and expensive to produce. This mechanism is not suitable for structuring a running track for the cable carrier of a crane, in uncomplicated manner, in such a way that they are only a slight distance apart at their transition points.

SUMMARY OF THE INVENTION

It is therefore an object of the invention to develop a multipart running track for cable carriers, which track can be separated along the displacement direction of the cable carriers, which has only a narrow gap at the transition points between two running track parts, in the closed state, and a simple mechanism brings about the slight gap width.

The solution according to the invention provides a crane with a boom and a running track for a cable carrier, in which two running tracks that engage into one another with a positive lock are present. One of the two running tracks is connected with the crane or the boom in a fixed manner, and the other running track is displaceable. The movable part of the running track is secured against axial play at its ends, with play, specifically in such a manner that free movement of the movable part of the running track, for the purpose of closing the join gap, is guaranteed in all operating conditions. It is practical if the movable part of the running track is suspended in a tongue-and-groove connection, which absorbs the weight force of the running track and the cable carriers that run on it, and also lateral forces, but permits an axial displacement.

It is advantageous to dispose the running track on the crane. This can be done in accordance with the state of the art. Furthermore, it is advantageous to dispose the other running track on the boom, in a displaceable manner. This displaceability can be achieved by means of springs that are produced between the boom and an attachment for the spring and between the running track and an attachment of the spring. Instead of a spring, however, mechanisms that guarantee the mobility of a running track in another way are also advantageous, for example a hydraulic suspension.

Springs that can be used are steel springs, helical springs, plastic springs, or rubber springs, or any type of spring that is suitable for pressing the movable running track for the cable carriers against the fixed running track with the required force, after the boom has been closed, so that no gap is present any longer. The number of required springs can easily be determined by a person skilled in the art who designs the crane.

The movement of the displaceable running track can also be undertaken by means of other suitable mechanisms, for example by means of a mechanical tracking system such as an electric spindle drive with a spindle, that the movable running track travels the required path difference, and that no gap is present any longer between the fixed and movable running track.

The ends of the running tracks that engage into one another can be configured in the shape of a semi-circle, S-shaped, pointed, slanted, straight, or in wave shape, in advantageous manner.

The ends of the running tracks are understood to be not only their lower running tracks, on which the wheels travel, which absorb the weight of the cable carrier, but also the lateral running surfaces, on which the rollers that support themselves laterally move.

The solution according to the invention guarantees that a gap is no longer present between the fixed and movable running track, since, as soon as the boom is folded upward, the springs move the movable running track in the direction towards the fixed running track. When the two running tracks are folded together, the springs are tensed counter to their bearing on the boom, and in this manner ensure that the two running tracks do not have a gap from one another at their join.

The proposed solution has the advantage that cable carriers can move on their running tracks between the crane and the boom with little wear and little noise development, and are subject to less stress, resulting in a longer useful lifetime and lower operating costs.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
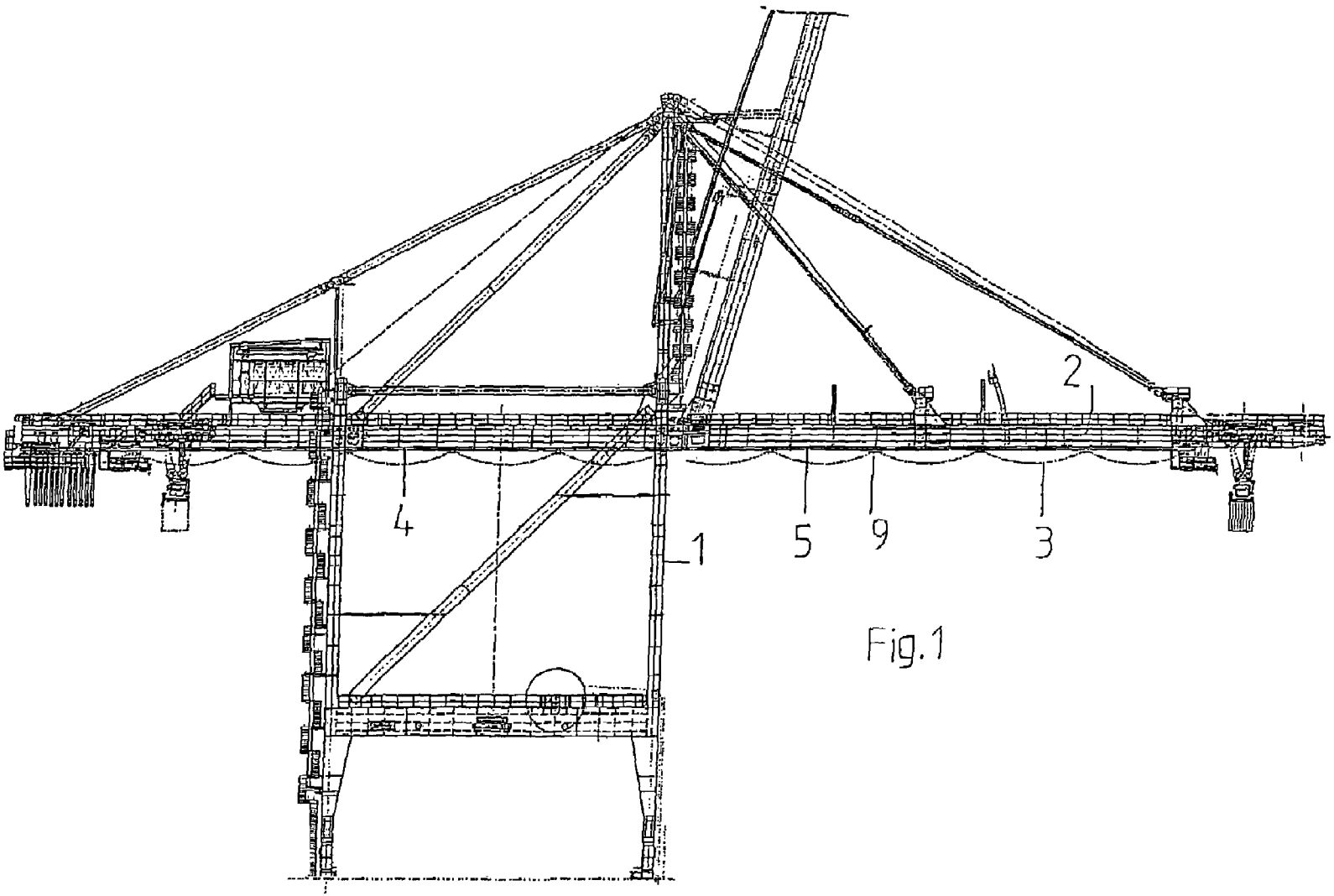
FIG. 1 shows a portal crane with boom according to an embodiment of the invention.

Referring now in detail to the drawings, FIG. 1 shows a portal crane 1 with a boom 2. Running tracks 4, 5 for a cable carrier (not shown) that carries lines 3 are disposed on the underside of the beam of boom 2 and crane 1.

Figure 2:
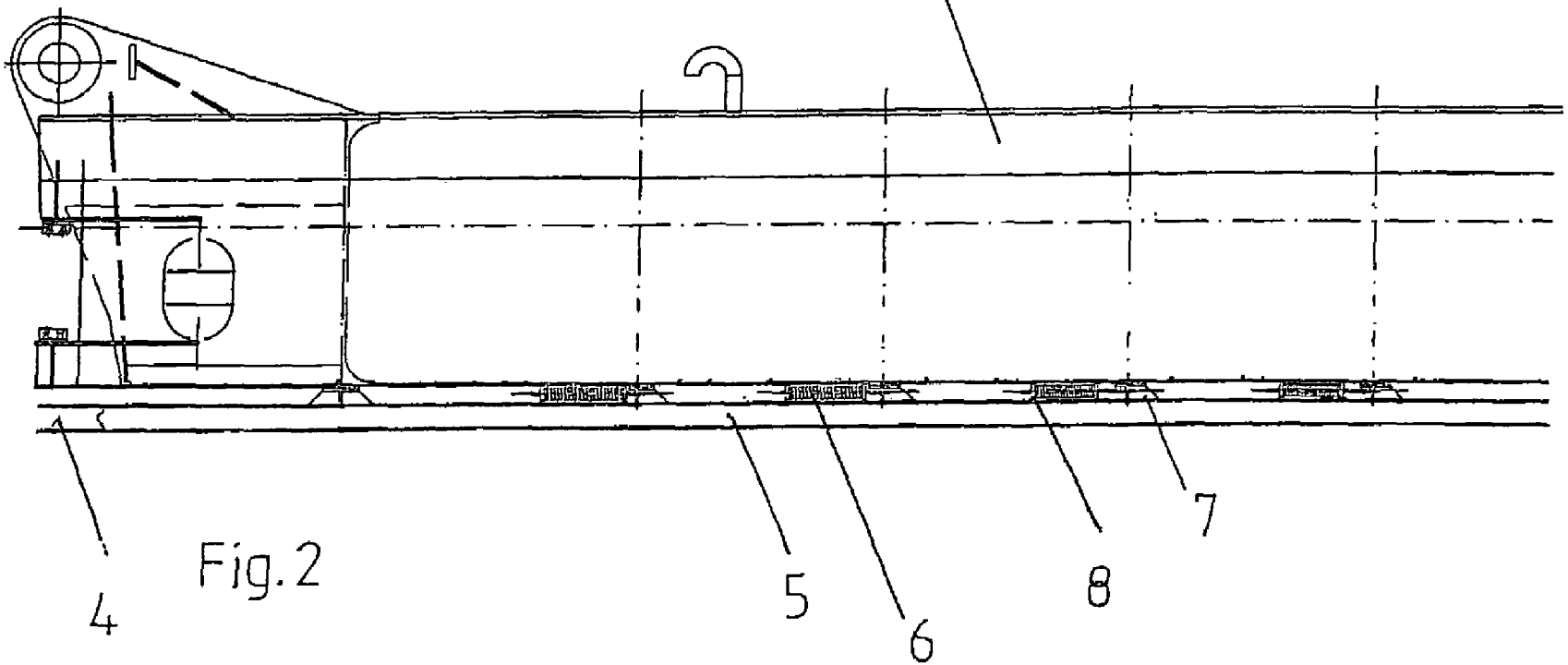
FIG. 2 shows a boom with running track and spring according to an embodiment of the invention.

FIG. 2 shows boom 2 of crane 1, on the underside of which a movable running track 5 is disposed, which follows a fixed running track 4 of the crane. Movable running track 5 has an attachment 8, counter to which spring 6 acts. On the other side, this spring acts against attachment 8' of boom 2. Movable running track 5 is suspended by a tongue-and-groove connection, which absorbs the weight force of running track 5 and carriers 9 that run on it.

Figure 2A:
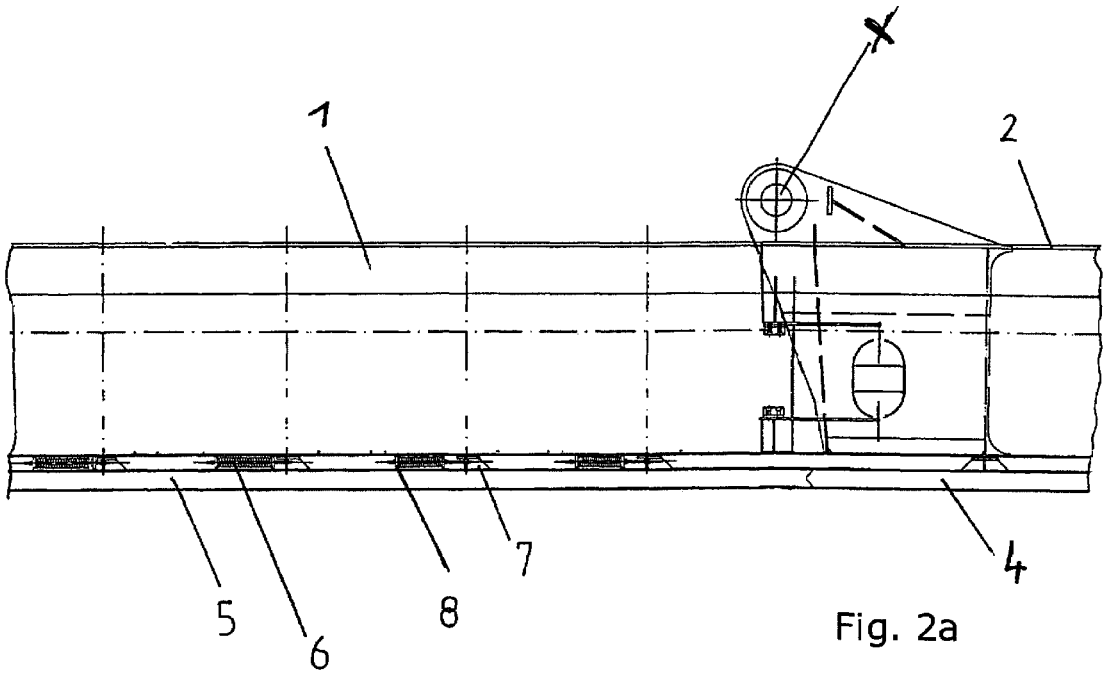
FIG. 2*a* shows an alternative embodiment of the crane and boom with running track and spring according to the invention.

FIG. 2*a* shows an alternative embodiment of the invention, in which fixed running track 4 is disposed on movable boom 2, and movable running track 5 is disposed on crane 1.

Figure 3:
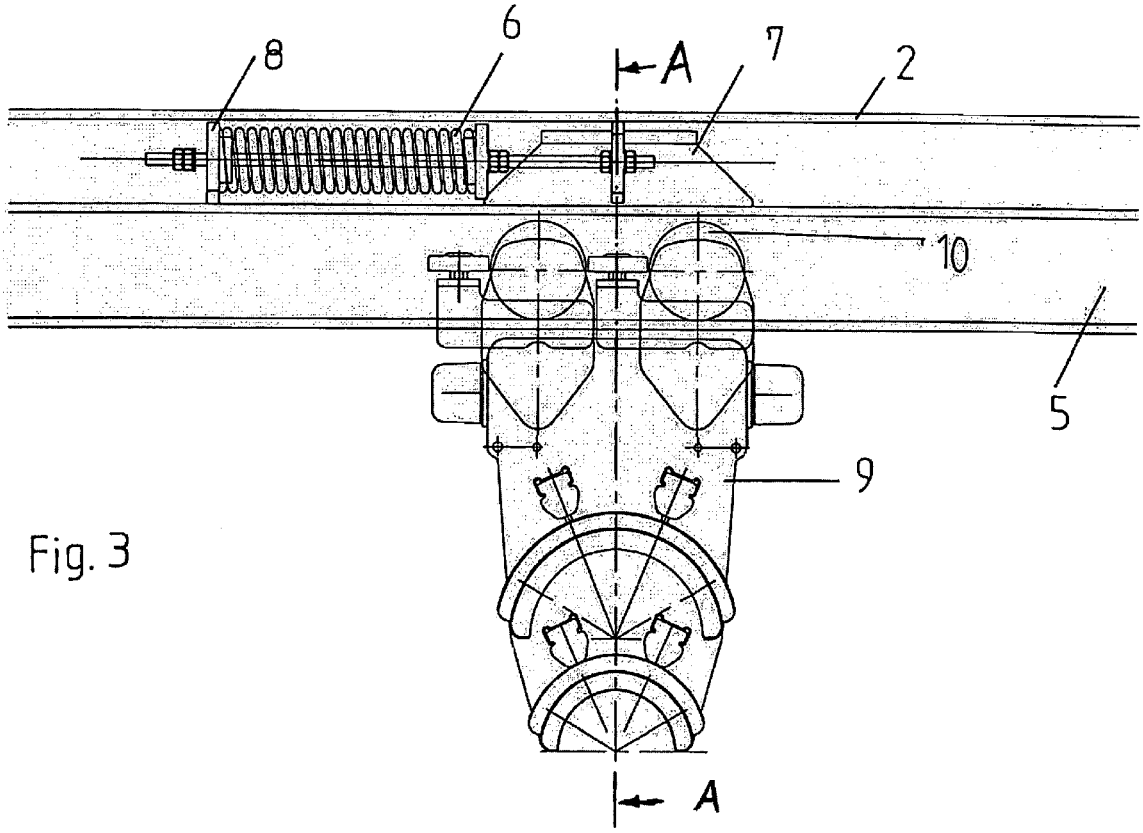
FIG. 3 shows a cable carrier on a movable running track according to an embodiment of the invention.

FIG. 3 shows cable carrier 9, which travels along the running tracks 4, 5 with its wheels or rollers. Attachment 8' on boom 2, spring 6, and attachment 7, 8 on movable running track 5 can be clearly seen.

Figure 4:
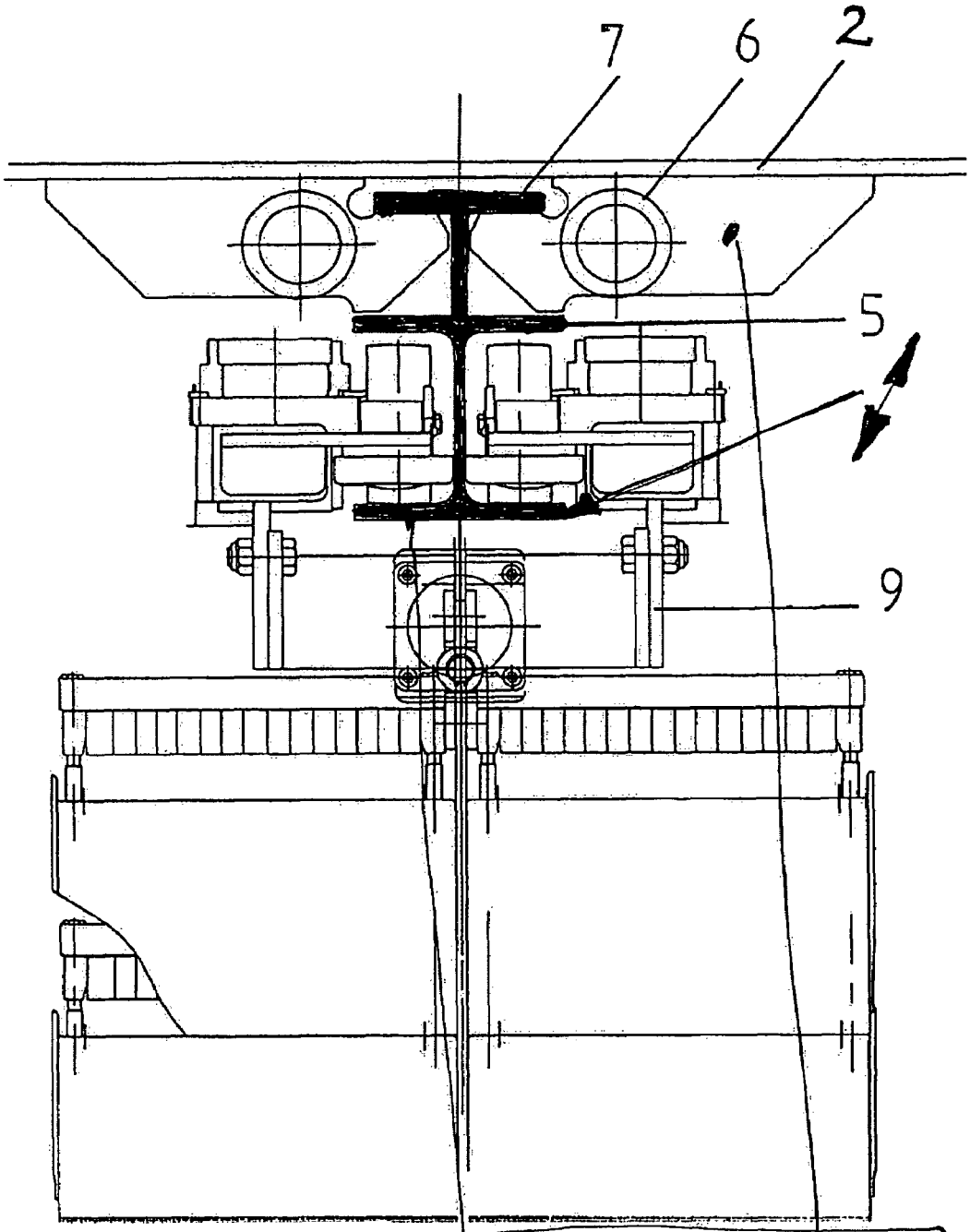
FIG. 4 shows a side view of FIG. 3.

The sectional view in FIG. 4 shows that the wheels or rollers act against the lower and side surface of the running tracks 4, 5, so these must be configured accordingly. FIGS. 3 and 4 show a tongue 7' attached to attachment 7, which are all attached to running part 5, and groove 6' in form part 8', which is attached to boom 2. Attachment 7 and tongue 7' glide within groove 6'. As stated above, this tongue-and-groove connection, suspends running track 5 on boom 2 and can absorb the weight force of running track 5 and carriers 9 that run on it.

Figure 5:
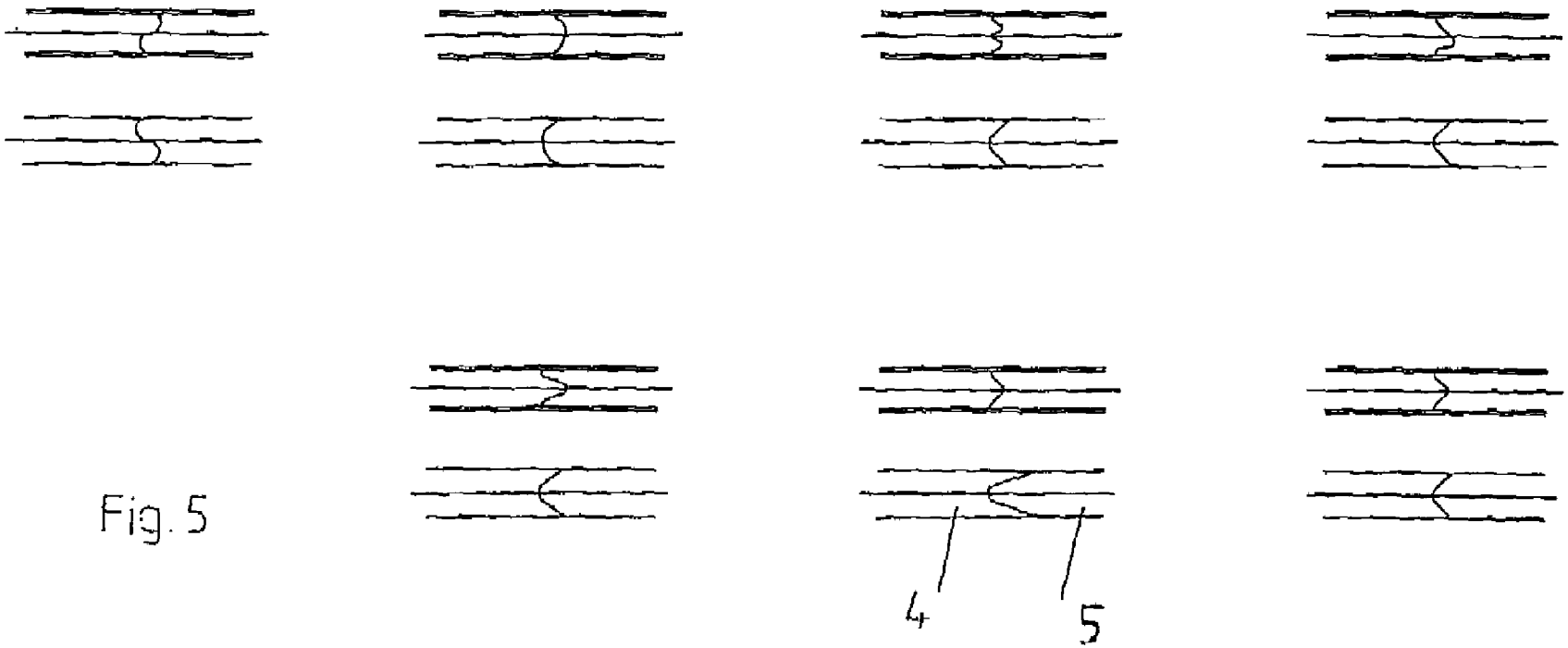
FIG. 5 shows advantageous embodiments of running tracks according to the invention.

FIG. 5 shows advantageous embodiment variants of these running tracks 4, 5.

The solution according to the invention guarantees that a gap at the join between the fixed and movable part of the running track 4, 5 is no longer present, since, as soon as boom 2 is folded upward, springs 6 move running track 5 in the direction towards fixed running track 4. When the two running tracks 4, 5 are folded together, springs 6 are tensed counter to their bearing 7 on boom 2, and in this manner ensure that the two running tracks 4, 5 do not have a gap from one another.

Figure 6:
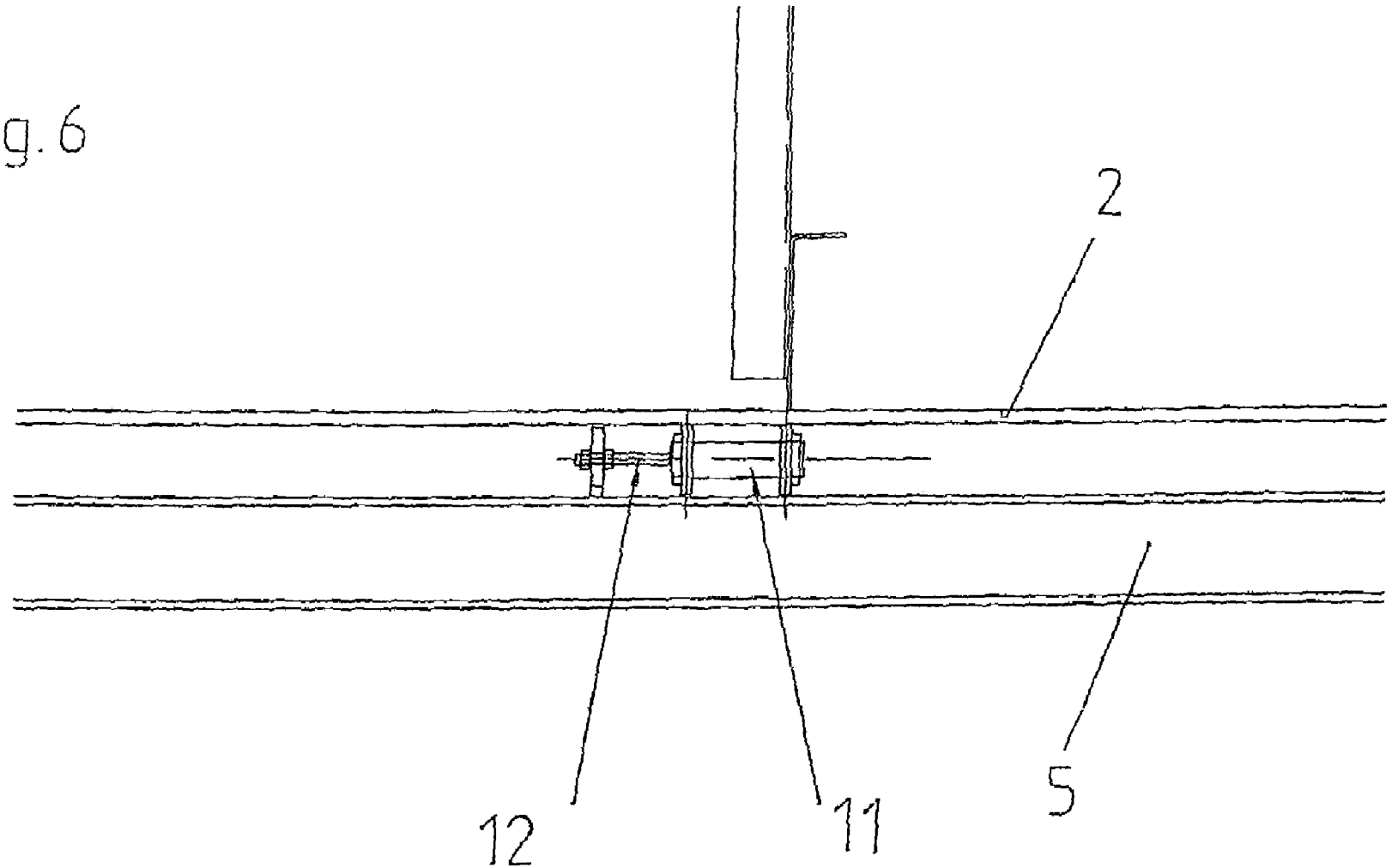
FIG. 6 shows a hydraulic mechanism having a hydraulic cylinder and piston rod.

FIG. 6 shows another alternative embodiment, in which there is a hydraulic mechanism consisting of a hydraulic cylinder 11 and a piston rod 12, disposed between movable running track 5 and boom 2.

Figure 7:
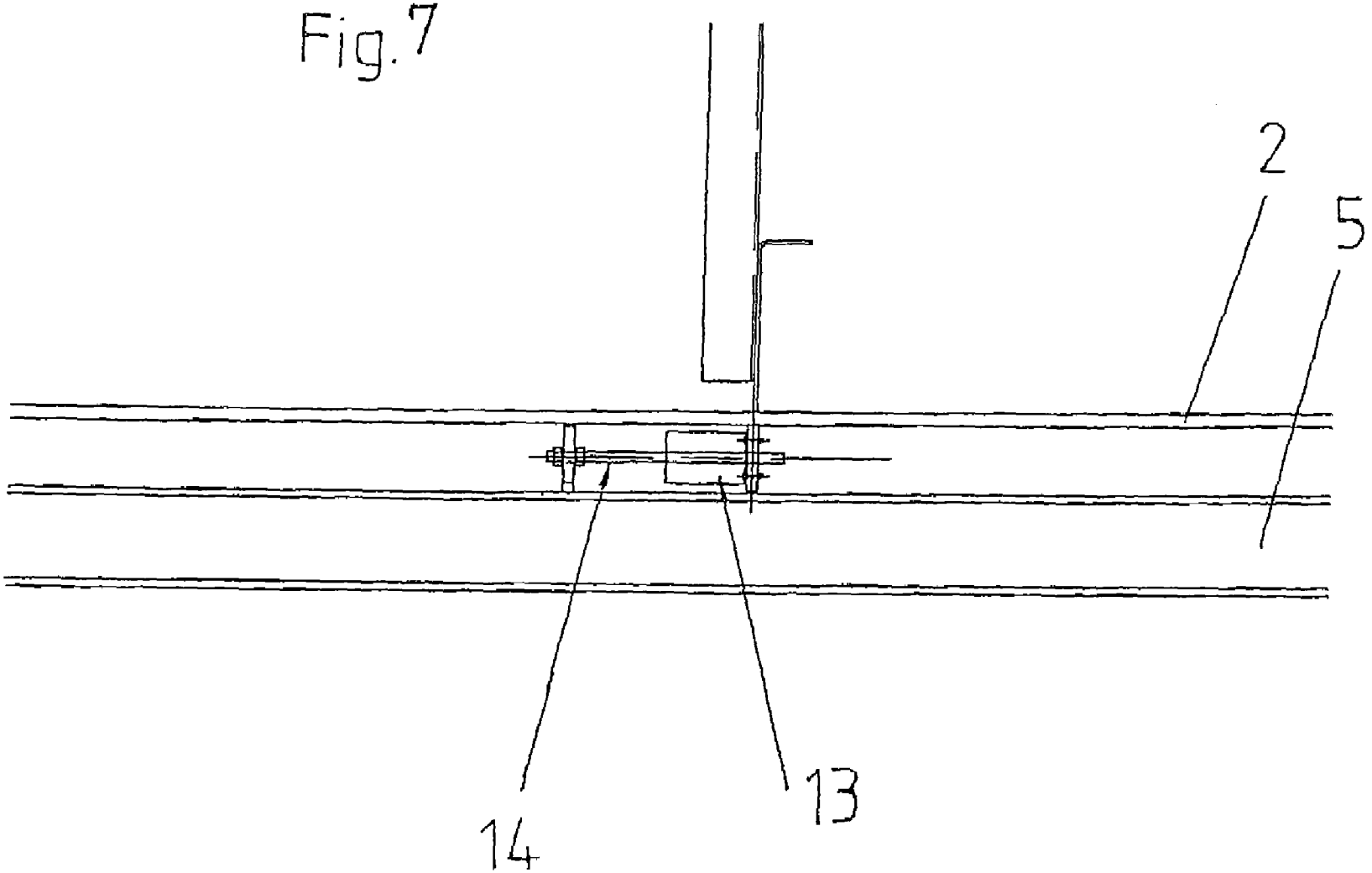
FIG. 7 shows a boom with a respective follow-up, having an electric spindle drive and a spindle.

FIG. 7 shows another alternative embodiment, in which boom 2 has an electric spindle drive 13 with a spindle 14 to move moveable running track 5.

Accordingly, while only a few embodiments of the present invention have been shown and described, it is obvious that many changes and modifications may be made thereunto without departing from the spirit and scope of the invention.

LIST OF REFERENCE SYMBOLS USED

1 crane
2 boom
3 line
4 running track, fixed
5 running track, movable
6 spring
7 attachment of the spring 6 to 2
8 attachment of the spring 6 to 5
9 cable carrier
10 wheels or rollers of 9
11 hydraulic cylinder
12 piston rod
13 electric spindle drive
14 spindle

What is claimed is:

1. A crane having a movable boom and comprising:

at least two running tracks for cable carriers, said at least two running tracks comprising a fixed running track and a movable running track, wherein said at least two running tracks engage into one another with a positive lock, said fixed running track being connected with a supporting structure of the crane or with the movable boom in a fixed manner, said movable running track being displaceable on the supporting structure of the crane or on the movable boom via springs disposed between the movable running track and the supporting structure of the crane or the movable boom, said springs being arranged parallel to a longitudinal axis of the movable running track, so that the movable running track can move in all operating conditions for closing a join gap, wherein pressure force from the springs moves the movable running track toward the fixed running track when the running tracks are folded together, to eliminate any gap between the running tracks.

2. The crane according to claim 1, wherein the fixed running track is disposed on the supporting structure of the crane and the movable running track is disposed on the movable boom.

3. The crane according to claim 1, wherein the movable running track is suspended on the movable boom by way of a tongue-and-groove connection, which can absorb a weight force of the movable running track and cable carriers that run on it.

4. The crane according to claim 1, wherein the spring is helical, steel, plastic or rubber.

5. The crane according to claim 1, wherein ends of the running tracks that engage into one another are in a shape selected from the group consisting of semi-circle, S-shaped, pointed, wave-shaped, slanted, and straight.

6. A crane having a movable boom and comprising:

at least two running tracks for cable carriers, said at least two running tracks comprising a fixed running track and a movable running track, wherein said at least two running tracks engage into one another with a positive lock, said fixed running track being connected with a supporting structure of the crane or with the movable boom in a fixed manner, said movable running track being displaceable on the supporting structure of the crane or on the movable boom, and wherein a hydraulic mechanism is disposed between the movable running track and the boom to move the movable running track relative to the boom and to close a gap between the running tracks.

7. A crane having a movable boom and comprising:

at least two running tracks for cable carriers, said at least two running tracks comprising a fixed running track and a movable running track, wherein said at least two running tracks engage into one another with a positive lock, said fixed running track being connected with a supporting structure of the crane or with the movable boom in a fixed manner, said movable running track being displaceable on the supporting structure of the crane or on the movable boom, and wherein a spindle with an electric spindle drive is disposed between the movable running track and the boom to move the running track relative to the boom and to close a gap between the running tracks.

* * * * *